US010036540B2

(12) United States Patent
Sekowski et al.

(10) Patent No.: US 10,036,540 B2
(45) Date of Patent: Jul. 31, 2018

(54) ROTATABLE AND TILTABLE LUMINAIRE

(71) Applicant: ABL IP Holding LLC, Decatur, GA (US)

(72) Inventors: Daniel Vincent Sekowski, Loganville, GA (US); Brent James Smith, McDonough, GA (US); Rick Martin Kelly, Newark, OH (US)

(73) Assignee: ABL IP Holding LLC, Atlanta, GA (US)

( * ) Notice: Subject to any disclaimer, the term of this patent is extended or adjusted under 35 U.S.C. 154(b) by 139 days.

(21) Appl. No.: 15/156,572

(22) Filed: May 17, 2016

(65) Prior Publication Data

US 2017/0248296 A1 Aug. 31, 2017

Related U.S. Application Data

(60) Provisional application No. 62/301,347, filed on Feb. 29, 2016.

(51) Int. Cl.

| | |
|---|---|
| ***F21V 21/00*** | (2006.01) |
| ***F21V 21/30*** | (2006.01) |
| *F21Y 101/02* | (2006.01) |
| *F21W 131/10* | (2006.01) |

(52) U.S. Cl.
CPC ..... *F21V 21/30* (2013.01); *F21W 2131/10* (2013.01); *F21Y 2101/02* (2013.01)

(58) Field of Classification Search
CPC ..... F21V 21/26; F21V 21/30; F21W 2131/10; F21Y 2102/02
See application file for complete search history.

(56) References Cited

U.S. PATENT DOCUMENTS

| | | | | |
|---|---|---|---|---|
| 4,851,973 | A * | 7/1989 | Layne | F21V 29/15 362/147 |
| 5,713,662 | A * | 2/1998 | Kira | F21V 21/28 362/269 |
| 5,833,358 | A * | 11/1998 | Patik | H01R 25/147 362/239 |
| 7,108,405 | B2 * | 9/2006 | Matts | F16C 11/103 248/222.52 |
| 7,648,253 | B2 | 1/2010 | Katz et al. | |
| 8,950,909 | B2 * | 2/2015 | Ramirez | F21S 8/03 362/371 |

(Continued)

FOREIGN PATENT DOCUMENTS

DE 4401342 A1 7/1995

OTHER PUBLICATIONS

Office Action for Canadian Patent Application No. CA 2,930,954 , dated May 1, 2017, (5 pages).

(Continued)

*Primary Examiner* — Ali Alavi
(74) *Attorney, Agent, or Firm* — Kilpatrick Townsend & Stockton LLP

(57) ABSTRACT

In one arrangement, a luminaire, for example a luminaire for outdoor lighting, includes a main portion, a pivot member, a swivel member, and a light head. The pivot member and swivel member cooperate to allow the light head to be positioned in any of a number of rotational positions about a first axis and in any of a number of rotational positions about a second axis. The first axis may be vertical, and the second axis may be horizontal.

12 Claims, 9 Drawing Sheets

(56) References Cited

U.S. PATENT DOCUMENTS

| | | | | |
|---|---|---|---|---|
| 2003/0021116 | A1* | 1/2003 | Miller | F21S 8/00<br>362/249.01 |
| 2009/0180301 | A1* | 7/2009 | Mier-Langner | F21S 8/038<br>362/648 |
| 2013/0027923 | A1 | 1/2013 | Ramirez | |

OTHER PUBLICATIONS

"Cree Edge™ LED High Output Luminaire," CREE, Retrieved from the internet:www.cree.com/lighting, Believed to be available at least as early as May 23, 2016, 4 pages.
"OSQ Series LED Area Light," CREE, Retrieved from the internet:www.lighting.cree.com, Believed to be available at least as early as May 23, 2016, 3 pages.
CA 2,930,954, "Office Action," dated Feb. 2, 2018, 4 pages.

* cited by examiner

ROTATABLE AND TILTABLE LUMINAIRE

This application claims the benefit of U.S. Provisional Patent Application No. 62/301,347, filed Feb. 29, 2016 and titled "Rotatable and Tiltable Luminaire", the entire contents of which are hereby incorporated by reference herein.

BACKGROUND

Luminaires are common for lighting parking lots and other outdoor spaces. Such luminaires are typically mounted on poles or walls of nearby buildings. To accommodate differences in the arrangement of different sites, it is desirable that a luminaire be configurable or adjustable at the time of mounting, so that light from the luminaire is directed to where it is most desired.

BRIEF SUMMARY

Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to one aspect, a luminaire comprises a main portion, a pivot member, a swivel member, and a light head. The pivot member is attachable to the main portion in any of a number of fixed rotational positions about a first axis, and the pivot member defines a second rotational axis. The swivel member is coupleable to the pivot member in any of a number of fixed rotational positions about the second rotational axis. The light head is attached to the swivel member.

According to another aspect, a set of parts for a luminaire comprises a main portion, a pivot member, a swivel member, a direct coupling member, and a light head. The main portion has a floor defining an opening. The pivot member has a body and an upper flange. The body of the pivot member is sized to be inserted in the opening in the floor of the main portion, and the upper flange is configured to rest on the floor of the main portion. The pivot member is attachable to the main portion in any of a number of fixed rotational positions about a first rotational axis, and the pivot member defines a second rotational axis. The swivel member is coupleable to the pivot member in any of a number of fixed rotational positions about the second rotational axis, and the swivel member includes attachment features. The direct coupling member has a body and an upper flange. The body of the direct coupling member is sized to be inserted in the opening in the floor of the main portion and the upper flange of the direct coupling member is configured to rest on the floor of the main portion. The direct coupling member is attachable to the main portion in any of a number of fixed rotational positions about the first axis, and the direct coupling member includes attachment features on a side opposite the upper flange. A light head is coupleable to the attachment features of the swivel member or to the attachment features of the direct coupling member.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below.

Figure 1:
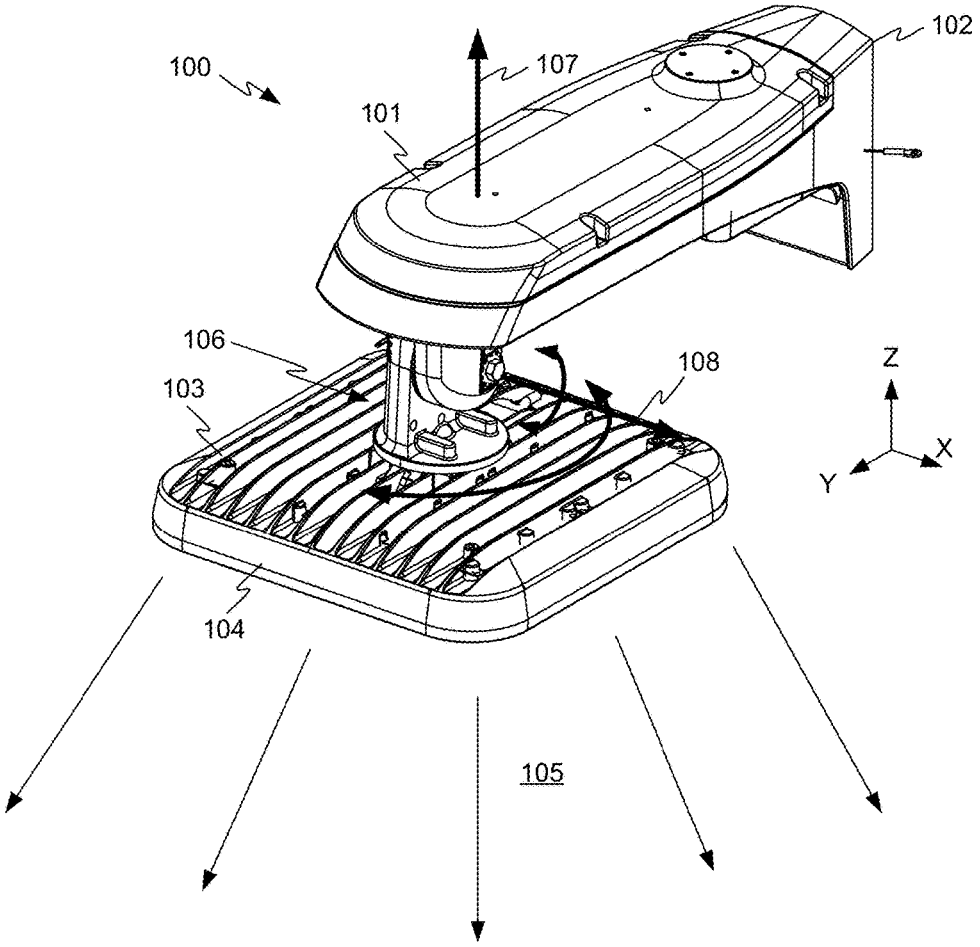
FIG. 1 illustrates an upper perspective view of a luminaire in accordance with an embodiment of the invention.

FIG. 1 illustrates an upper perspective view of a luminaire 100 in accordance with an embodiment of the invention. Example luminaire 100 has a main portion 101 having a mounting end 102, configured to mount to a pole, wall, or other structure. Luminaire 100 may be especially suitable for lighting an outdoor space such as a parking lot, but the invention is not so limited. While FIG. 1 is described as an "upper" view, this designation is arbitrary and for descriptive purposes only. Luminaire 100 may be installed in any orientation.

Light head 103 includes a housing 104, and holds one or more light engines (not visible in FIG. 1) that generate light 105 generally directed away from light head 103. The distribution of light emanating from light head 103 may not be symmetrical. For example, light 105 may spread more in the X direction than in the Y direction, or vice versa. Or light 105 may be directed preferentially in the +Y direction as opposed to the −Y direction, so as to broadly illuminate an area in front (+Y) of luminaire 100 while casting only minimal light on a wall to which luminaire 100 may be mounted. Any suitable and achievable light spread pattern may be used.

While light head 103 is shown as having a generally square footprint, this is not a requirement. In other embodiments, light head 103 may be rectangular, oval, circular, or another shape.

Luminaire 100 includes a "knuckle" 106, which in concert with main portion 101 permits rotation of light head 103 about vertical axis 107, and also about horizontal axis 108. Either or both rotations may be used, to direct light 105 in any accessible direction. That is, light head 103 is positionable in two degrees of freedom with respect to main portion 101 or a part of main portion 101. Preferably, but not necessarily, axis 108 is orthogonal to axis 107.

Figure 2:
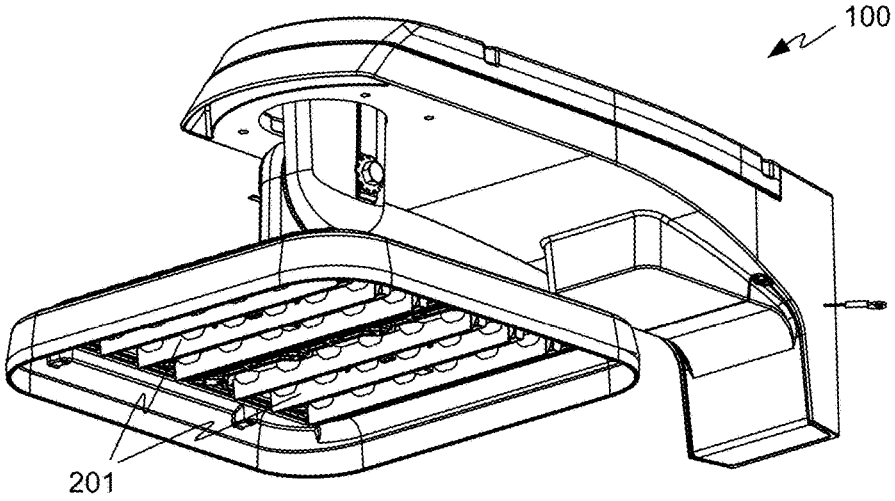
FIG. 2 illustrates a lower perspective view of the luminaire of FIG. 1.

FIG. 2 is a lower perspective view of luminaire 100. Two light engines 201 are visible, enclosed in housing 104. Light engines 201 may comprise, for example, a number of light emitting diodes (LEDs) and light shaping optics for directing the light generated by the LEDS in a desired pattern. However, the invention is not so limited, and a luminaire according to embodiments of the invention may use other kinds of light sources, for example incandescent, fluorescent, mercury vapor, sodium vapor, electroluminescent, or other kinds of light sources.

Figure 3:
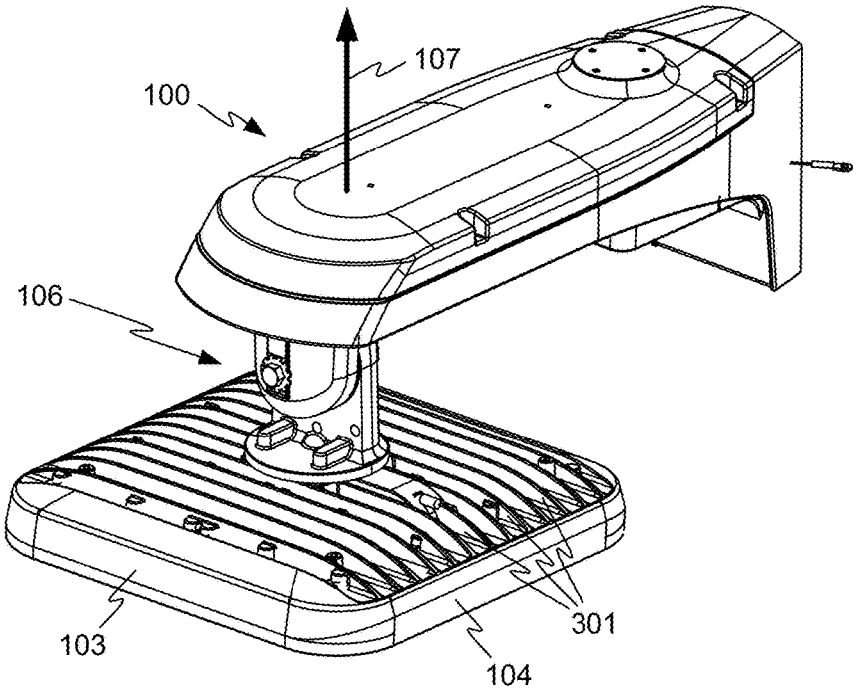
FIG. 3 illustrates an upper perspective view of the luminaire of FIG. 1.

FIG. 3 is an upper perspective view of luminaire 100. FIG. 3 is similar to FIG. 1, except that light head 103 has been rotated 90 degrees about axis 107 from the configuration shown in FIG. 1, as evidenced by the orientation of knuckle 106 and ribs 301 visible on the top surface of housing 104. Ribs 301 may be provided for stiffening housing 104, for promoting dissipation of heat generated by light engines 201, or for other purposes. In other embodiments, no ribs may be provided, or other structural or decorative features may be present.

Figure 4:
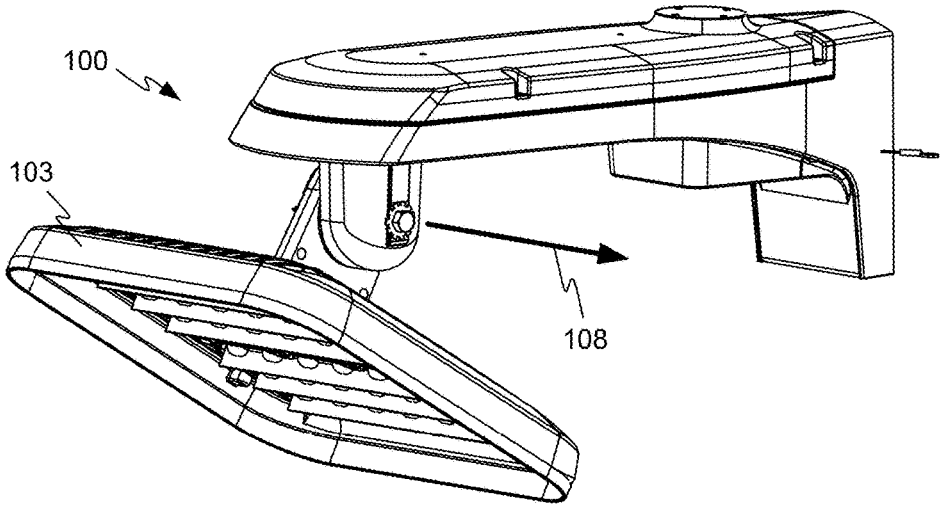
FIG. 4 illustrates another upper perspective view of the luminaire of FIG. 1.

FIG. 4 is another upper perspective view of luminaire 100. FIG. 4 is similar to FIG. 1, except that light head 103 has been rotated 30 degrees about axis 108 from the configuration shown in FIG. 1.

Figure 5:
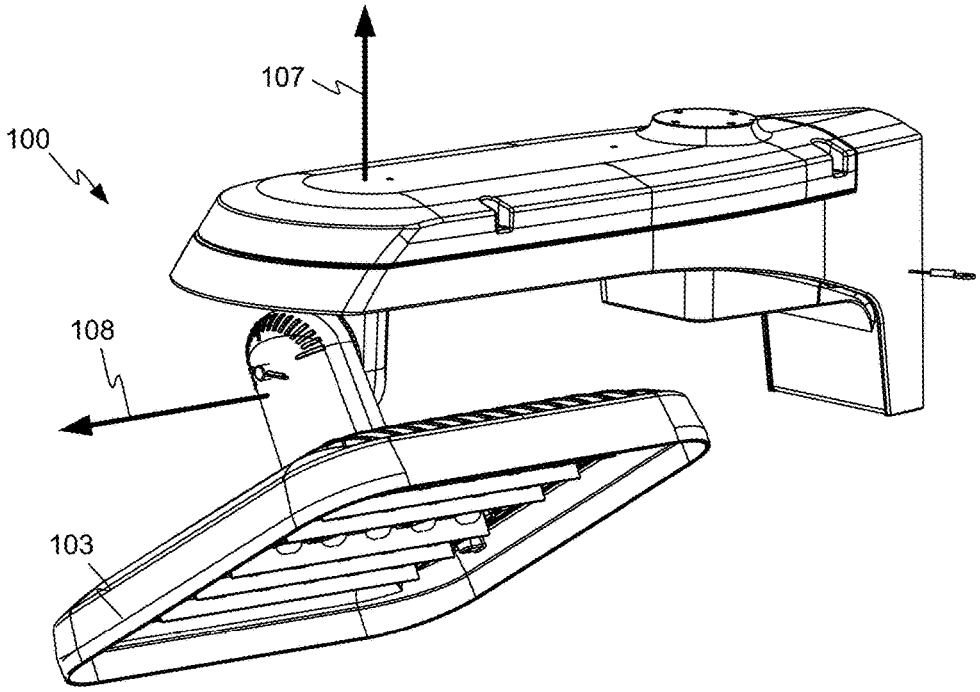
FIG. 5 illustrates another upper perspective view of the luminaire of FIG. 1.

FIG. 5 is another upper perspective view of luminaire 100, in which light head 103 has been rotated 90 degrees about axis 107 and also has been rotated 30 degrees about axis 108 (which itself has been rotated about axis 107). Light head 103 may be rotated in either direction about either axis, alone or in combination.

Figure 6:
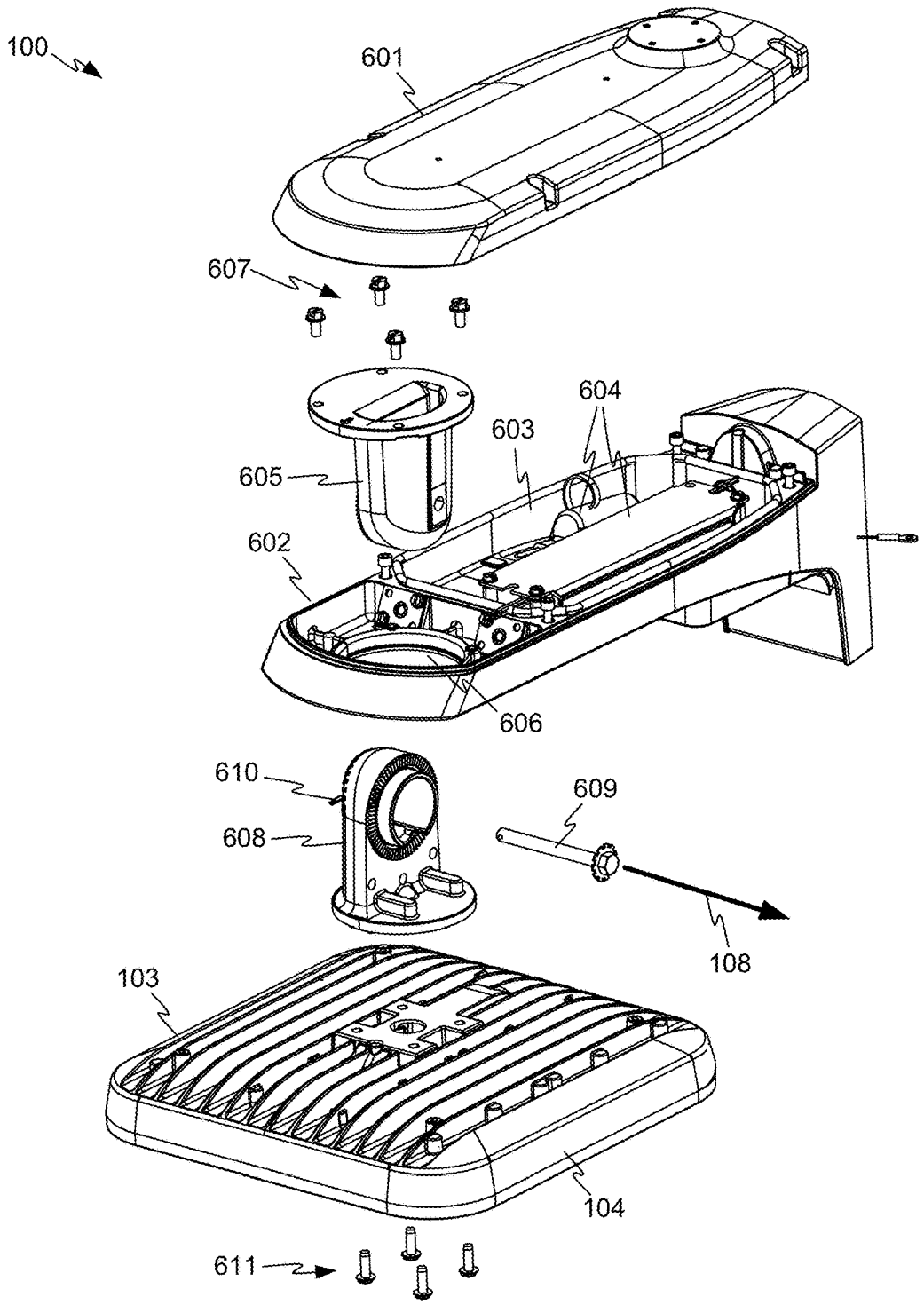
FIG. 6 illustrates an exploded view of the luminaire of FIG. 1.

FIG. 6 is an exploded view of luminaire 100, illustrating additional structural details, including details of knuckle 106. In FIG. 6, lid 601 has been removed from frame 602, exposing compartment 603 holding electrical components 604 of luminaire 100. When luminaire 100 is assembled, pivot member 605 extends through opening 606 in frame 602, and is fixed to frame 602 using screws 607, which thread into complementary threaded holes in frame 602. In the example of FIG. 6, four screws 607 and complementary holes are shown, so that pivot member 605 can be installed in any of four rotational positions spaced 90 degrees apart. In other embodiments, more or fewer mounting holes may be provided, and pivot member 605 may be installable in more or fewer rotational positions.

Figure 7:
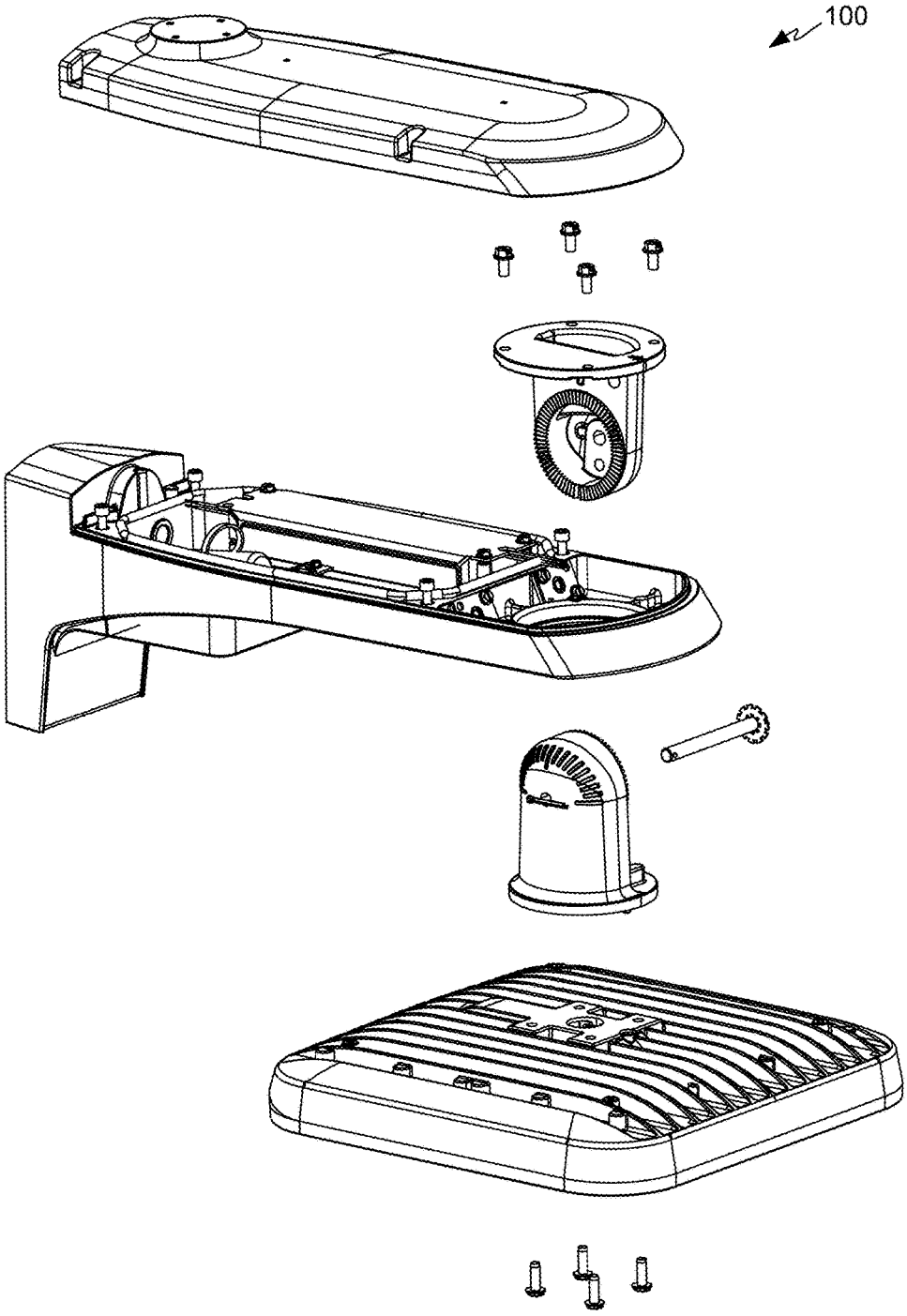
FIG. 7 illustrates alternate exploded view of the luminaire of FIG. 1, from a different viewing angle.

A swivel member 608 couples to pivot member 605, and is rotatable with respect to pivot member 605 to provide rotation of swivel member 608 about axis 108. An axle 609 holds pivot member 605 and swivel member 608 together, and may be secured using a cotter pin 610 or other fastener, to hold swivel member 608 in its installed position with respect to pivot member 605. Light head 103 is attached to swivel member 608 using screws 611 which pass through housing 104 and thread into swivel member 608. FIG. 7 is an alternate exploded view of luminaire 100, from a different viewing angle. Additional details of knuckle 106 are provided below.

Figure 8:
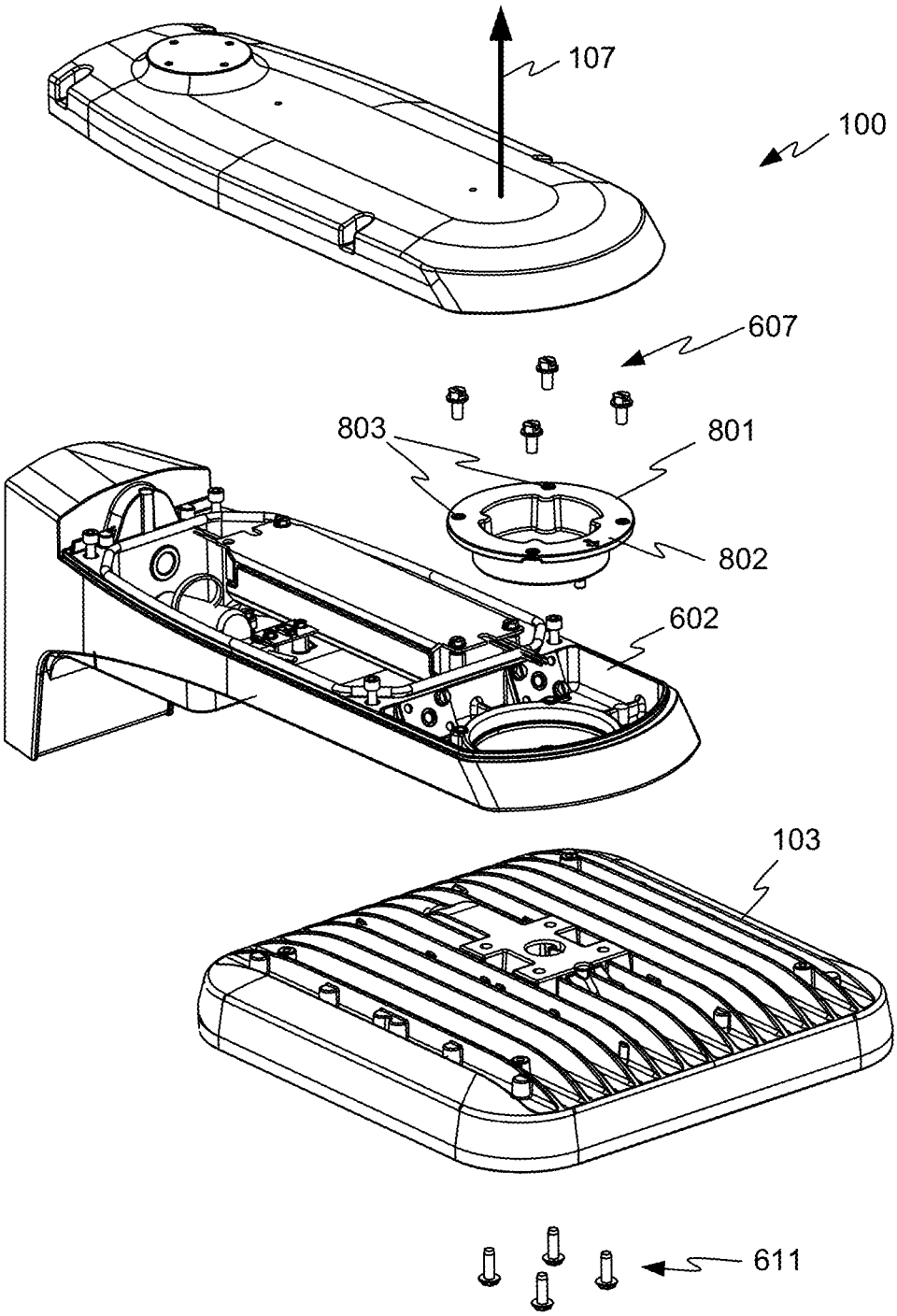
FIG. 8 illustrates an exploded view of a luminaire according to another embodiment.

FIG. 8 is an exploded view of luminaire 100 according to another embodiment. In the example of FIG. 8, knuckle 106 has been replaced by a direct coupling member 801. While example direct coupling member 801 is generally cup-shaped, this is not a requirement. An upper flange 802 of direct coupling member 801 is similar or substantially identical to an upper flange of pivot member 605, and includes a hole pattern 803 like the pattern in the upper flange of pivot member 605. Thus, screws 607 can be used to affix direct coupling member 801 to frame 602 in the same manner as the attachment of pivot member 605 to frame 602 shown in FIG. 6.

Similarly, the bottom surface of direct coupling member 801 includes a pattern of threaded holes (not visible in FIG. 8) like the pattern of holes in the bottom of swivel member 608. Thus, light head 103 can be attached to direct coupling member 801 using screws 611, in the same manner as the attachment of light head 103 to swivel member 608 shown in FIG. 6. In the example of FIG. 8, direct coupling member 801 replaces knuckle 106, and light head 103 can be positioned in any of several rotational positions about axis 107, but no secondary rotation (like that about axis 108) is provided. That is, in the embodiment of FIG. 8, light head 103 can be positioned in only one degree of freedom with respect to frame 602. All of the parts of luminaire 100 except for direct coupling member 810 and knuckle 106 may be identical in the embodiments of FIGS. 6 and 8. Luminaire 100 may thus be tailored to individual installation situations by using either a knuckle 106 or a direct coupling member 801 for mounting light head 103.

The various parts of luminaire 100 may be made of any suitable materials. For example, in some embodiments lid 601, frame 602, pivot member 605, swivel member 608, direct coupling member 801, and housing 104 may conveniently be made of a die cast metal such as aluminum, magnesium, or zinc. In other embodiments, various parts may be made of molded polymer, sheet metal, a composite, or other materials or combination of materials. These parts need not all be made of the same material.

Figure 9:
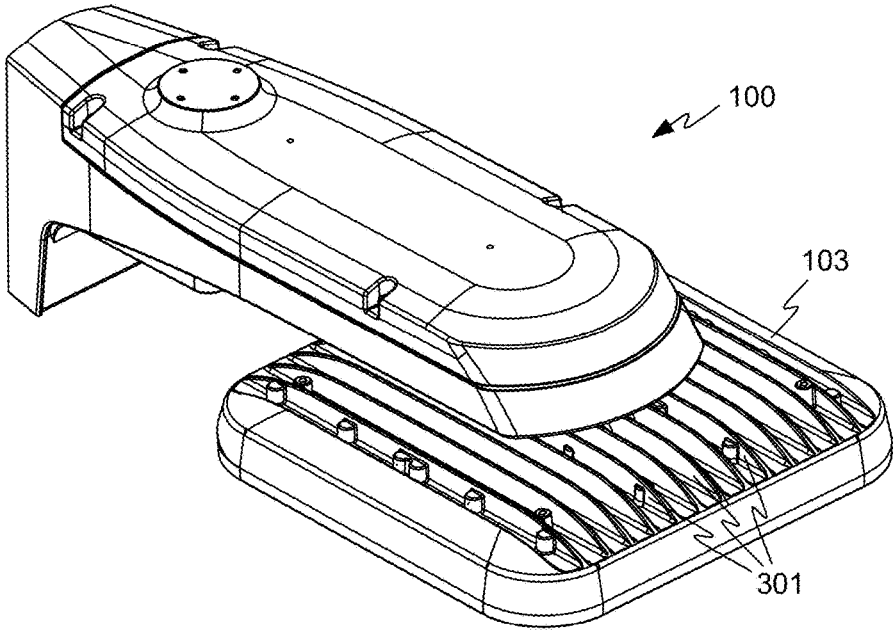
FIGS. 9 and 10 illustrate the luminaire of FIG. 8 with its light head configured in two different rotational positions.
Figure 10:
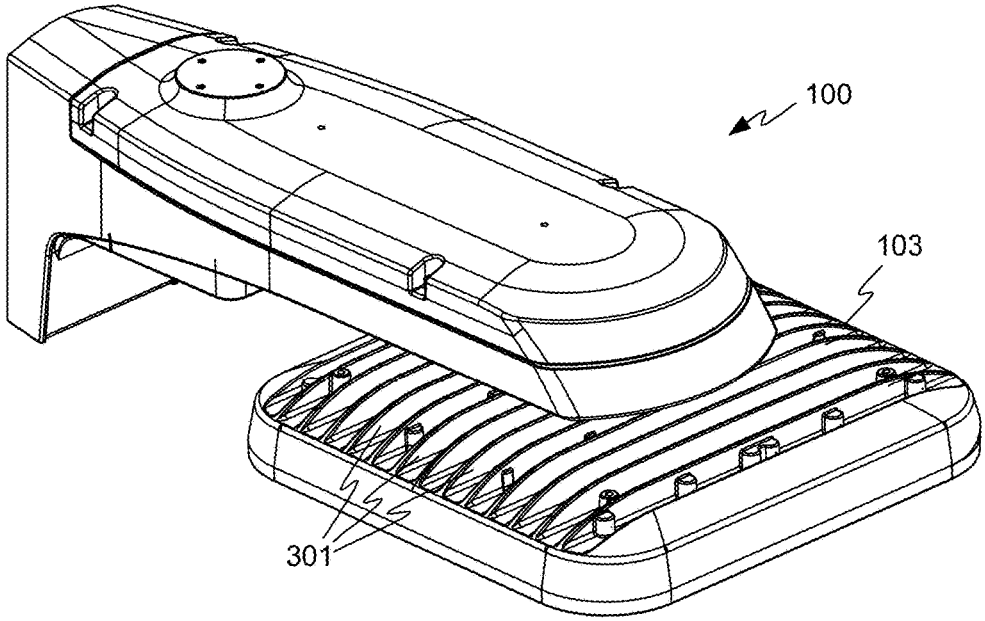

FIGS. 9 and 10 illustrate luminaire 100 having direct coupling member 801 installed (rather than knuckle 106), with light head 103 configured in two different rotational positions, as evidenced by the different orientations of ribs 301 in the two figures.

Figure 11:
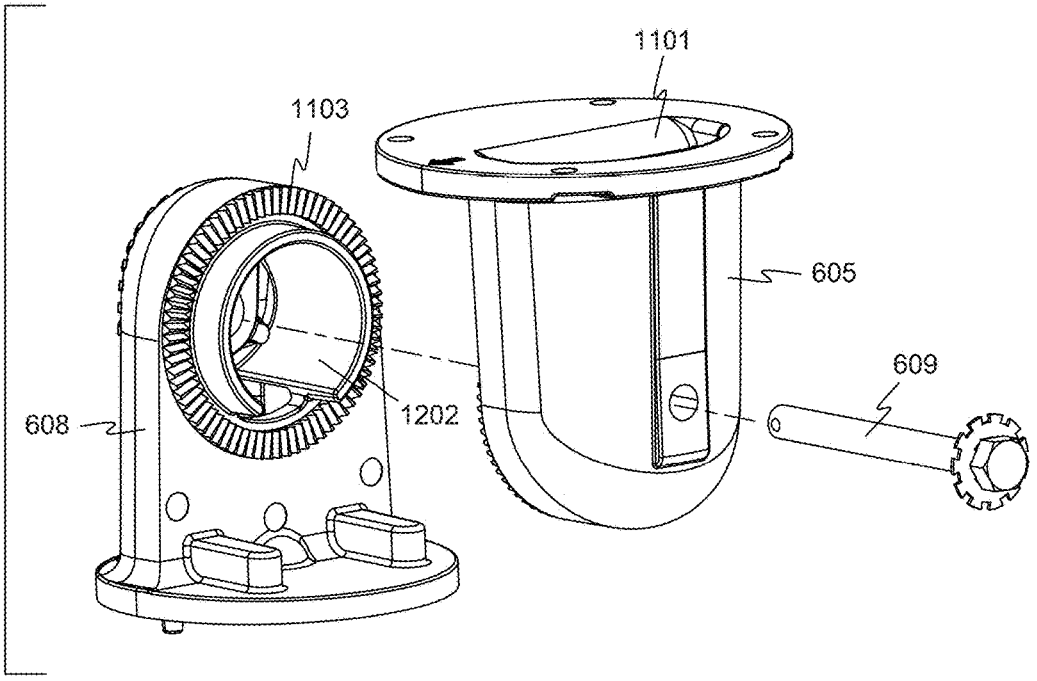
FIG. 11 is an exploded upper perspective view of a pivot member and a swivel member, in accordance with an embodiment of the invention.
Figure 12:
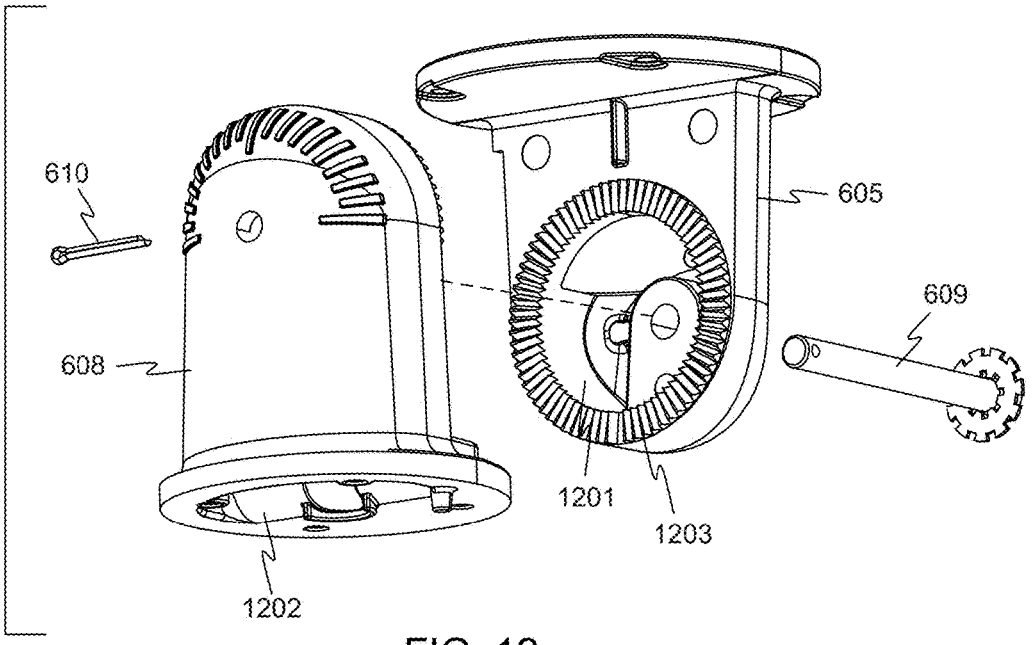
FIG. 12 is an exploded perspective view of the pivot member and swivel member of FIG. 11, from the reverse angle of FIG. 11.

FIG. 11 is an exploded upper perspective view of pivot member 605 and swivel member 608, showing additional details of their construction in the example embodiment. FIG. 12 is also an exploded perspective view of pivot member 605 and swivel member 608, from the reverse angle of FIG. 11.

Referring to both FIGS. 11 and 12 together, pivot member 605 is hollow, so that wires (not shown) from electrical components 604 can pass through top opening 1101 of pivot member 605 and through pivot member side opening 1201. Similarly, swivel member 608 is hollow, so that the wiring can pass through swivel member side opening 1102 and through bottom opening 1202 to reach light head 103. Teeth 1103 and 1203 engage to hold swivel member 608 in its installed orientation about axis 108 with respect to pivot member 605. Cotter pin 610 holds axle 609 in place, and also holds pivot member 605 and swivel member 608 together with teeth 1103 and 1203 engaged. Angular adjustment of swivel member 608 can be accomplished by removing cotter pin 610, separating teeth 1103 and 1203, rotating swivel member 608 about axle 609 with respect to pivot member 605 to the new desired position, re-engaging teeth 1103 and 1203, and re-inserting cotter pin 610 into axle 609. Other kinds of fasteners or other fastening methods may be used as well.

Figure 13:
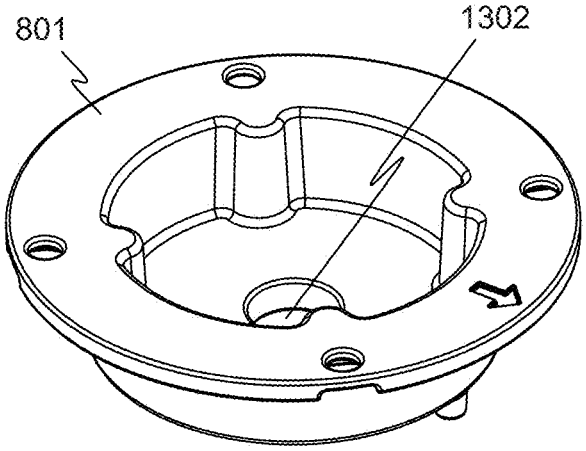
FIGS. 13 and 14 are upper and lower perspective views of an example direct coupling member of the luminaire of FIG. 8, showing additional details.
Figure 14:
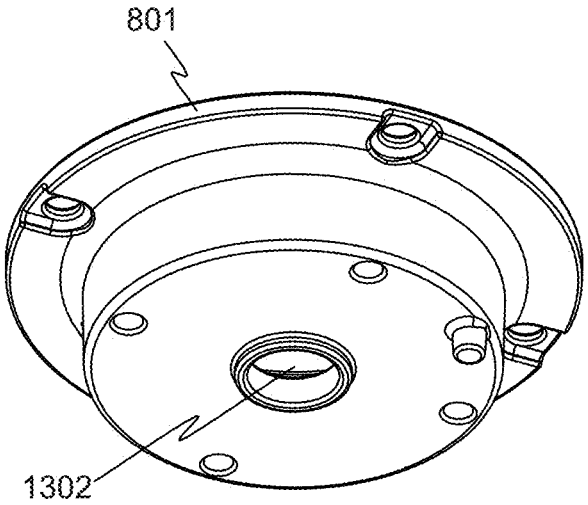

FIGS. 13 and 14 are upper and lower perspective views of example direct coupling member 801, showing additional details. In particular, direct coupling member 801 defines an opening 1302 through which wires (not shown) may be routed from electrical components 604 to light head 103.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

What is claimed is:

1. A luminaire, comprising:

a main portion defining an enclosure;

drive electronics disposed within the enclosure;

a pivot member attachable to the main portion in any of a number of fixed rotational positions about a first axis, the pivot member defining a second rotational axis;

a swivel member coupleable to the pivot member in any of a number of fixed rotational positions about the second rotational axis; and a light head attached to the swivel member, the light head receiving power from the drive electronics;

wherein the main portion includes a floor defining an opening and the pivot member includes a body and an upper flange, and wherein flange is disposed within the enclosure and rests on the floor of the main portion, and the body of the pivot member extends through the opening and out of the enclosure.

2. The luminaire of claim 1, wherein the first and second rotational axes are orthogonal to each other.

3. The luminaire of claim 2, wherein the first axis is a vertical axis and the second axis is a horizontal axis.

4. The luminaire of claim 1, wherein the fixed rotational positions of the pivot member about the first axis are defined by a hole pattern in the upper flange of the pivot member and a corresponding hole pattern in the floor of the main portion.

5. The luminaire of claim 4, wherein the fixed rotational positions of the swivel member about the second axis are defined by a number of teeth on the pivot member and a complementary set of teeth on the swivel member.

6. The luminaire of claim 1, wherein both the pivot member and swivel member are hollow such that a continuous wiring path exists from the interior of the main portion, through the pivot member, through the swivel member, and to the light head.

7. The luminaire of claim 6, further comprising one or more light emitting diodes (LEDs) disposed in the light head, the drive electronics and the LEDs being connected by wiring routed through the wiring path.

8. A set of parts for a luminaire, the set of parts comprising:

a main portion having a floor defining an opening;

a pivot member having a body and an upper flange, the body sized to be inserted in the opening in the floor of the main portion and the upper flange configured to rest on the floor of the main portion, the pivot member being attachable to the main portion in any of a number of fixed rotational positions about a first rotational axis, and the pivot member defining a second rotational axis;

a swivel member coupleable to the pivot member in any of a number of fixed rotational positions about the second rotational axis, the swivel member including attachment features;

a direct coupling member having a body and an upper flange, the direct coupling member body sized to be inserted in the opening in the floor of the main portion and the upper flange of the direct coupling member configured to rest on the floor of the main portion, the direct coupling member being attachable to the main portion in any of a number of fixed rotational positions about the first axis, and the direct coupling member including attachment features on a side opposite the upper flange; and a light head coupleable to the attachment features of the swivel member or to the attachment features of the direct coupling member.

9. The set of parts of claim 8, wherein the main portion, pivot member, swivel member, and light head are assemblable into a luminaire in which the light head can be positioned in two degrees of freedom with respect to the main portion, and wherein the main portion, direct coupling member, and light head are assemblable into a luminaire in which the light head can be positioned in one degree of freedom with respect to the main portion.

10. The set of parts of claim 8, wherein the first and second rotational axes are orthogonal to each other.

11. The set of parts of claim 8, wherein the upper flange of the direct coupling member is substantially identical to the upper flange of the pivot member, and wherein the attachment features of the direct coupling member are substantially identical to the attachment features of the swivel member.

12. The set of parts of claim 8, wherein the direct coupling member defines a through hole for the passage of wiring from the interior of the main portion to the light head.

* * * * *